US012060760B2

(12) United States Patent
Elliott

(10) Patent No.: US 12,060,760 B2
(45) Date of Patent: Aug. 13, 2024

(54) COMMUNICATION SYSTEMS AND METHODS

(71) Applicant: Expro North Sea Limited, Aberdeenshire (GB)

(72) Inventor: David Robert Elliott, Poole (GB)

(73) Assignee: Expro North Sea Limited, Dyce (GB)

( * ) Notice: Subject to any disclaimer, the term of this patent is extended or adjusted under 35 U.S.C. 154(b) by 256 days.

(21) Appl. No.: 17/612,891

(22) PCT Filed: May 20, 2020

(86) PCT No.: PCT/EP2020/064057

§ 371 (c)(1),
(2) Date: Nov. 19, 2021

(87) PCT Pub. No.: WO2020/234344

PCT Pub. Date: Nov. 26, 2020

(65) Prior Publication Data

US 2022/0082012 A1 Mar. 17, 2022

(30) Foreign Application Priority Data

May 21, 2019 (GB) ..... 1907154

(51) Int. Cl.

| | |
|---|---|
| ***E21B 33/12*** | (2006.01) |
| ***E21B 23/06*** | (2006.01) |
| ***E21B 33/14*** | (2006.01) |
| ***E21B 47/13*** | (2012.01) |
| ***E21B 47/14*** | (2006.01) |

(52) U.S. Cl.

CPC ..... *E21B 33/1208* (2013.01); *E21B 23/06* (2013.01); *E21B 33/14* (2013.01); *E21B 47/13* (2020.05); *E21B 47/14* (2013.01)

(58) Field of Classification Search

None

See application file for complete search history.

(56) References Cited

U.S. PATENT DOCUMENTS

| | | | | |
|---|---|---|---|---|
| 6,478,086 | B1 | 11/2002 | Hansen | |
| 2012/0073805 | A1 | 3/2012 | Shampine | |
| 2017/0081956 | A1 | 3/2017 | Ganguly | |
| 2019/0195062 | A1 * | 6/2019 | Espe | E21B 36/00 |

FOREIGN PATENT DOCUMENTS

| | | | |
|---|---|---|---|
| WO | 2018178606 | A1 | 10/2018 |
| WO | 2020144091 | A2 | 7/2020 |

* cited by examiner

*Primary Examiner* — Carlos Garcia
(74) *Attorney, Agent, or Firm* — Getz Balich LLC

(57) ABSTRACT

In described examples, there are methods and systems for communicating data signals in wells. The methods and systems may facilitate communication of data signals, for example, from an open-hole section of a well, or in a well having a discontinuous metallic well structure.

20 Claims, 5 Drawing Sheets

COMMUNICATION SYSTEMS AND METHODS

This application claims priority to PCT Patent Appln. No. PCT/EP2020/064057 filed May 20, 2020, which claims priority GB Patent Appln. No. 1907154.7 filed May 21, 2019, which are herein incorporated by reference.

BACKGROUND OF THE INVENTION

1. Technical Field

Described examples relate to methods, systems and apparatus for wells, such as oil and gas wells. Some examples relate specifically to methods, systems and apparatus for communicating data signals in wells.

2. Background Information

A communication apparatus for a well may be configured to use one or more types of signaling such as electromagnetic (EM) and/or acoustic signaling to provide data communication with an additional communication apparatus such as a surface communication apparatus and/or a communications repeater. Such signaling may depend on the quality of a connection between the communication apparatus and an interior surface of the well. For example, a good quality electrical connection may facilitate EM signaling and a good quality mechanical connection may facilitate acoustic signaling.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

In described examples, there are methods and systems for communicating data signals in wells. The methods and systems may facilitate communication of data signals, for example, from an open-hole section of a well, or in a well having a discontinuous metallic well structure.

According to an aspect or embodiment, there is provided a downhole method comprising: providing a portion in a fluid state that conforms to an interior surface at a location in a well. The portion may form a connection between the interior surface and a communication apparatus in the well to facilitate communication of data signals through a subterranean region.

By providing the portion in a fluid state, the portion may conform to a surface profile of the interior surface. Properties such as viscosity, surface resistance, or the like of the fluid portion may be such as to achieve a desired surface contact area in applications where there may be difficulties in achieving a good quality connection between the interior surface and the communication apparatus. For example, in the case of an uneven or rough interior surface profile such as in an open-hole section of a well, the portion may be selected to provide a sufficient surface contact area between the portion and the interior surface. If there is a sufficient surface contact area between the portion and the interior surface for a given application, a good quality connection between the communication apparatus and the interior surface may be provided to facilitate communication of data signals through a subterranean region. In other similar words, the connection provided by the portion may facilitate communication of data signals through the subterranean region via the portion. As such, the quality of the connection may affect the communication of data signals.

Some optional features of the aspect or embodiment are set out below.

The downhole method may comprise forming, with the portion, an electrical connection between the interior surface and the communication apparatus.

The downhole method may comprise forming, with the portion, an acoustic connection between the interior surface and the communication apparatus.

The downhole method may comprise forming the connection in an open-hole section of the well.

The downhole method may comprise forming the connection in a metallic well structure section of the well.

Providing the portion in the fluid state may comprise providing the portion in a solid state and subsequently changing state of the portion to form a fluid portion that conforms to the interior surface. For example, the solid portion may be a material with a melting temperature selected such that, when heated, the solid portion melts to form the fluid portion.

Providing the portion in a fluid state may comprise initially providing the portion in the fluid state, the portion being configured to remain in the fluid state when conformed to the interior surface. For example, the portion may comprise a mud, gel or other such fluid, e.g. conductive fluid, which does not change state for particular conditions in the well (e.g. the characteristics of the portion may be selected based on having a viscosity appropriate for expected well conditions). In some examples, the portion, and in particular the fluid properties of the portions, may be selected such that, in use, and when in a fluid state, the portion need not or does not leach into surrounding formation, e.g. during deployment or indeed over time.

The downhole method may comprise allowing the portion to conform to the interior surface and subsequently changing state of the portion to form a solid portion. For example, the portion may comprise a material that undergoes a change of state after a period of time due to one or more of: a chemical reaction, temperature change, pressure change, or the like. The portion may undergo the change of state by itself (e.g., due to environmental conditions, a time-delayed chemical reaction, or the like) or an action such as provision of at least one further material may cause the portion to change its state.

The portion may comprise metal. The metal may comprise metal alloy. The metal may comprise bismuth. The metal may comprise a cast metal. The metal may comprise metallic particles.

The portion may comprise settable material. The settable material may be configured to initially be in a fluid state, and upon setting, be in a solid state. The settable material may comprise metal, cement, mud, gel, etc. The settable material may comprise conductive particles, for example, comprising metal.

The method may comprise isolating a section of the well with the portion. For example, the portion may be used to plug the well.

The method may comprise deploying, in the well, at least one of: the communication apparatus and an installation system for providing the portion.

The method may comprise using at least one of an electric line, a slick line, drill pipe and/or coiled tubing, etc., to deploy at least one of: the communication apparatus and the installation system.

The method may comprise providing settable material in an annulus between a monitoring system associated with the communication apparatus and the interior surface of the well. The method may comprise setting the settable material. The method may comprise perforating the settable material (e.g., after the settable material has set) to provide pressure communication between the monitoring system and a surrounding formation. The settable material may comprise cement, or the like. The portion may comprise the settable material. The monitoring system may be comprised in or otherwise in communication with the communication apparatus.

The method may comprise communicating data signals between the communication apparatus and at least one additional communication apparatus via the subterranean region.

Communicating data signals between the communication apparatus and the at least one additional communication apparatus via the subterranean region may comprise communicating data signals between two or more of: at least one downhole communication apparatus; at least one communications repeater and at least one surface communication apparatus.

According to an aspect or embodiment there is provided a communication method for a well comprising a communication apparatus installed in the well in accordance with the method of any aspect or embodiment described herein. The method may comprise monitoring one or more downhole conditions. The method may comprise using the communication apparatus to communicate data signals indicative of one or more of the downhole conditions.

According to an aspect or embodiment there is provided a method for a well comprising a communication apparatus installed in the well in accordance with the method of any aspect or embodiment described herein. The method may comprise isolating at least one section of the well to abandon the well. The method may comprise monitoring one or more downhole conditions of the abandoned well. The method may comprise using the communication apparatus to communicate data signals indicative of one or more of the downhole conditions.

According to an aspect or embodiment there is provided a communication system for a well. The system may comprise a communication apparatus. The system may comprise an installation system. The installation system may be configured to provide a portion in a fluid state that conforms to an interior surface at a location in the well. The portion may form a connection between the interior surface and the communication apparatus to facilitate communication of data signals through a subterranean region.

Some optional features of the aspect or embodiment are set out below.

The portion may be configured to form an electrical connection between the interior surface and the communication apparatus.

The portion may be configured to form an acoustic connection between the interior surface and the communication apparatus.

The portion may be configured to initially be in a solid state. The installation system may be configured to subsequently change state of the portion to form a fluid portion that conforms to the interior surface.

The installation system may be configured to initially provide the portion in the fluid state. The fluid portion may be configured to remain in that fluid state when conformed to the interior surface.

The portion may be configured to conform to the interior surface and subsequently change its state to form a solid portion.

The portion may comprise metal.

The portion may comprise settable material.

The installation system may be configured to provide the connection between the interior surface and the communication apparatus at a first location and an additional connection between the interior surface and the communication apparatus at a second location spaced from the first location.

The installation system may comprise at least one installation apparatus. The installation apparatus may be configured to provide the portion in the fluid state to form the connection. The installation apparatus may be configured to provide a different type of connection to that provided by the portion.

The additional connection may comprise an additional portion.

The additional connection at the second location may comprise a different type of connection to that provided by the portion at the first location.

The additional connection may comprise a packer arrangement.

The connection and the additional connection may comprise the same portion.

The communication apparatus may be configured to use near-field communication to facilitate communication of data signals through the subterranean region.

The connection and the additional connection may provide electrical contact between the communication apparatus and the interior surface of the well.

The communication apparatus may comprise at least one of: at least one downhole communication apparatus and at least one communications repeater.

The communication system may comprise at least one additional communication apparatus for communicating data signals with the communication apparatus via the subterranean region.

The at least one additional communication apparatus may comprise at least one of: at least one communications repeater and at least one surface communication apparatus.

According to an aspect or embodiment there is provided a well comprising a communication system according to any aspect or embodiment described herein.

The invention includes one or more corresponding aspects, embodiments or features in isolation or in various combinations whether or not specifically stated (including claimed) in that combination or in isolation. As will be appreciated, features associated with particular recited embodiments relating to systems may be equally appropriate as features of embodiments relating specifically to methods of operation or use, and vice versa.

It will be appreciated that one or more embodiments/aspects may be useful in effective monitoring of a well, e.g. exploration wells, abandoned wells, and may help monitor conditions accurately, for example, during and/or after the life of any well. The above summary is intended to be merely exemplary and non-limiting.

BRIEF DESCRIPTION OF THE DRAWINGS

A description is now given, by way of example only, with reference to the accompanying drawings, in which.

DETAILED DESCRIPTION OF THE INVENTION

Figure 1A:
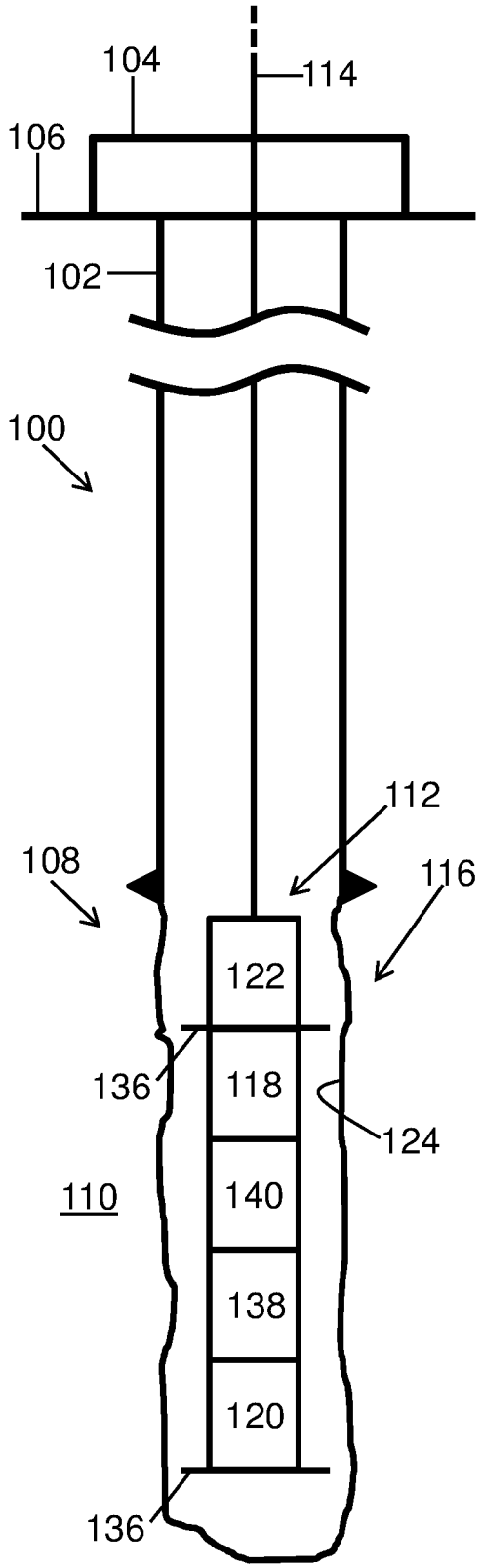
FIG. 1A is a schematic representation of a communication apparatus deployed in a well.

The following examples may be described in relation to oil and gas wells, and in particular exploration and appraisal wells, for example. However, the same methods and systems may be used in other types of wells or may be used beyond oil and gas applications. A skilled reader will be able to implement those various alternative embodiments accordingly.

Some of the following examples have been described in relation to wells having sections that are open-hole specifically with reference to exploration wells, or the like. However, it will be appreciated that aspects of the following methods and systems may equally be used with other wells and well structures having open-hole sections, such as appraisal well, production wells, injections wells, or the like, or pilot holes, side tracks, etc.

Generally, disclosed herein are methods and systems for providing a connection between a communication apparatus and an interior surface of a well. The connection may provide at least one of an electrical and acoustic connection between the communication apparatus and the interior surface in order to facilitate communication of data signals through a subterranean region.

In an example, the connection may be provided in an open-hole section of the well. Data signals may propagate (e.g., wirelessly) through the open-hole section to facilitate communication between a communication apparatus and at least one additional communication apparatus. For example, data signals may propagate via the open-hole section for receipt at infrastructure configured to receive those data signals. Such infrastructure may comprise at least one of: at least one downhole communication apparatus; at least one metallic well structure section; at least one surface communication apparatus; and at least one communications repeater provided between the downhole communication apparatus and the surface communication apparatus. For example, data signals propagated via an open-hole section may be received at a metallic well structure section for propagation via (e.g., along) that metallic well structure section.

In an example, the connection may be provided in a metallic well structure section of the well. Data signals may be guided via the metallic well structure section to facilitate communication between the communication apparatus such as a downhole communication apparatus and/or communications repeater and at least one additional communication apparatus such as a surface communication apparatus and/or a communications repeater.

In an example, data signals may be injected into a metallic well structure section for propagation via that metallic well structure section. For example, the communication apparatus and/or at least one additional communication apparatus may be configured to inject data signals into the metallic well structure section. Data signals that propagate via the metallic well structure section may be received at infrastructure configured to receive those data signals, as described herein.

In an example, data signals may propagate via a signal path comprising both a metallic well structure section and an open-hole section. The well may have a discontinuous metallic well structure meaning that the metallic well structure section may not be used as a sole medium to communicate the data signals.

In an example, data signals propagated via an open-hole section may be received at a communications repeater. The communications repeater may be located in an open-hole section and/or in a metallic well structure section. The communications repeater may re-transmit data signals for receipt at infrastructure configured to receive those data signals, as described herein. For example, the communications repeater may be configured to amplify and/or re-encode received data signals for re-transmission. The communications repeater may be configured to communicate using one or both of electromagnetic (EM) and acoustic signaling. For example, the communications repeater may be configured to receive data signals using one or both of: EM and acoustic signaling, and may be configured to transmit received data signals (whether amplified, re-encoded, or otherwise) using one or both of: EM and acoustic signaling.

FIG. 1A depicts a simplified representation of a well 100. A metallic well structure section 102 extends downhole from a wellhead 104 at a surface 106 of the well 100. An open-hole section 108 of the well 100 extends below the metallic well structure 102 and intersects a formation 110 of interest such as a hydrocarbon-bearing formation. In this example, the open-hole section may be considered to terminate at the bottom of the well, i.e. beyond the well structure. However, of course, a skilled reader will appreciate that in alternative examples, further well structure may extend beyond the open-hole section, as will be appreciated. Further, as will be appreciated given the following examples, in some cases the described apparatus or features thereof may be utilized to help communicate signals across an open-hole section, e.g. between upper and lower sections of well structure. A skilled reader will readily be able to implement those alternative embodiments accordingly.

Here, a tool 112 for performing various operations is deployed into the well 100. In this embodiment, the tool 112 is configured to monitor the properties of fluid in the formation 110 as part of a well appraisal operation. The tool 112 is deployed with cabling 114 such as electric line (e-line) or slickline to locate the tool 112 within the open-hole section 108, which may save time compared with certain other deployment methods. In other embodiments, the tool 112 may be deployed with other technology such as coiled tubing or may be deployed as part of a tool string, tubing string, drill pipe string, or the like.

The tool 112 forms part of a communication system 116 that comprises a downhole communication apparatus 118 and an installation system, which in this embodiment comprises an installation apparatus 120, 122 provided at each end of the tool 112. The installation apparatus 120, 122 are configured to provide contact with an interior surface 124 of the well 100 to provide two connections between the interior surface 124 and the downhole communication apparatus 118. The installation apparatus 120, 122 are configured to provide the two connections at spaced-apart locations relative to the tool 112 such that one of the connections is adjacent one end of the tool 112 and another of the connections is adjacent the other end of the tool 112. The connection provided by the contact with the interior surface 124 may facilitate communication of data signals through the subterranean region surrounding the downhole communication apparatus 118. One or more embodiments described herein may provide the downhole communication apparatus 118 with a signaling range sufficient to facilitate communication through the subterranean region surrounding the downhole communication apparatus 118. In some cases, this signaling range may reduce requirements for additional infrastructure such as at least one communications repeater to be installed in the well 100 to facilitate such communication, which may simplify the installation of the communication system 116 and may save time and/or costs associated with that installation.

Infrastructure within the surrounding subterranean region may comprise at least one of: additional communication apparatus such as a communications repeater and well structures such as the metallic well structure section 102. The well structures may or may not be metallic. One or more features of this infrastructure may form part of a signal path for communication of the data signals in order to facilitate communication between through the subterranean region. The signaling range of the downhole communication apparatus 118 may depend on the quality of the connection between the downhole communication apparatus 118 and the interior surface 124. In other similar words, the nature of the contact with the interior surface 124 may influence the signaling range of the downhole communication apparatus 118. For example, providing a good quality connection (as described further herein) with the interior surface 124 of the open-hole section 108 may provide the downhole communication apparatus 118 with a sufficient signaling range so that the downhole communication apparatus 118 can be located a significant distance away (e.g. greater than 100 meters, 500 meters, or the like) from infrastructure (e.g. the metallic well structure section 102 and/or other communication apparatus, or the like) forming part of the signal path.

Figure 1B:
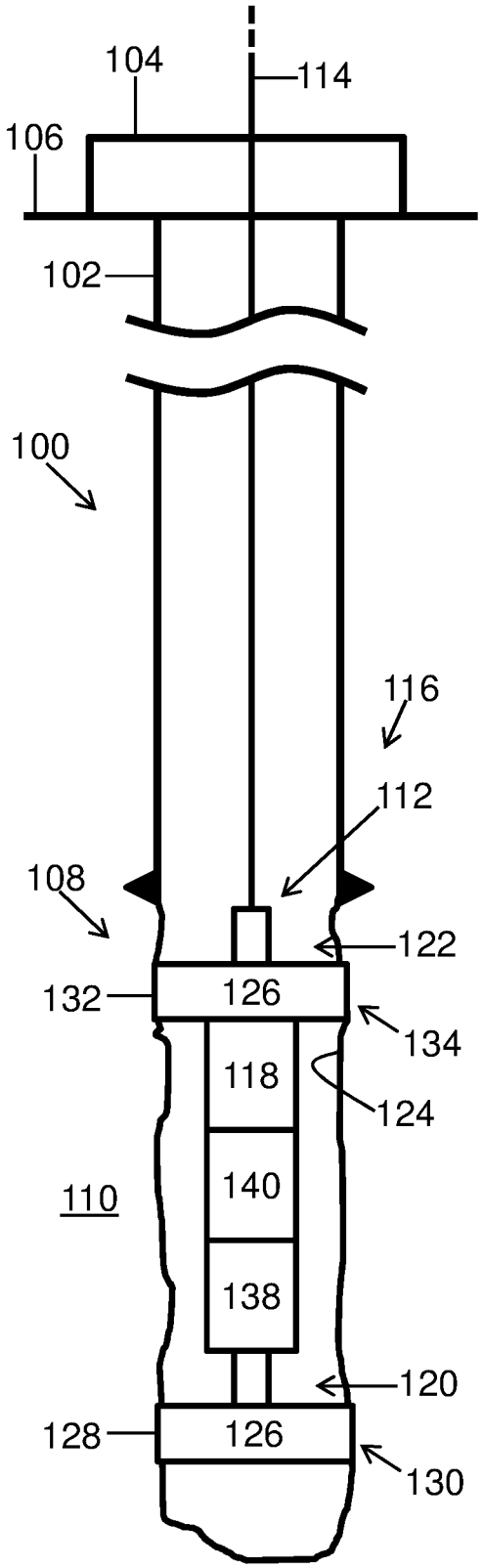
FIG. 1B is a schematic representation of the communication apparatus of FIG. 1A being installed in the well.
Figure 1C:
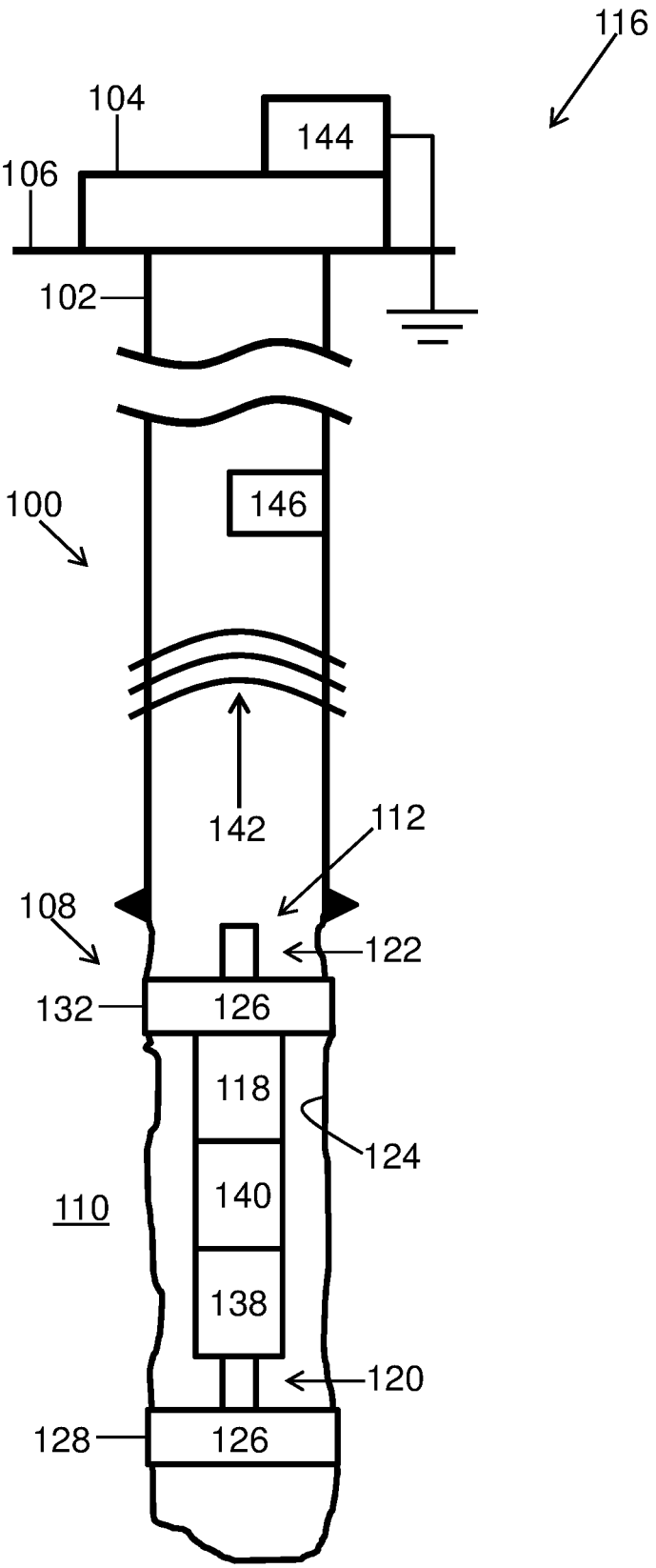
FIG. 1C is a schematic representation of a communication system comprising the communication apparatus of FIG. 1B.

As depicted by FIGS. 1B to 1C, the installation apparatus 120, 122 are each configured to provide a portion 126 at or near each end of the tool 112 that, in use, can be used to conform to the interior surface 124 of the well 100 to form a connection between the interior surface 124 and the downhole communication apparatus 118 to facilitate communication of data signals through the subterranean region. In this embodiment, the portion 126 is initially provided in a fluid state that conforms to the surface profile of the interior surface 124.

The degree to which the portion 126 conforms to the interior surface 124 depends on the surface contact area between portion 126 and the interior surface 124. The properties of the portion 126 may be such so as to achieve a desired surface contact area in applications where there may be difficulties in achieving a good quality connection between the interior surface 124 and the downhole communication apparatus 118. For example, in the case of an uneven or rough interior surface 124 profile such as in the open-hole section 108 (compared with the relatively even or smooth interior surface profile of the metallic well structure section 102), the portion 126 may be selected (e.g., fluidic properties such as viscosity and/or surface resistance may be selected) to provide a sufficient surface contact area between the portion 126 and the interior surface 124. In other similar words, the surface resistance of the portion 126 may be selected such that the portion 126 conforms to the interior surface 124 of the well 100. A good quality connection between the interior surface 124 and the downhole communication apparatus 118 may be provided where there is a sufficient surface contact area between the portion 126 and the interior surface 124 for a given application.

In the embodiment of FIGS. 1A to 1C, the downhole communication apparatus 118 is configured as a dipole antenna for communicating data signals using an EM method. In this embodiment, the EM method comprises using near-field communication (for example, in the non-radiative near-field) to facilitate communication of data signals through the subterranean region. The near-field region may be found within a distance that is one wavelength or less from an antenna.

The frequency used for communication of the data signals may affect the distance between a transmitter and a receiver over which reliable communication can be achieved. Data signals communicated in the well 100 may be transmitted at frequencies below those used in some other EM methods for communicating data signals. For example, the downhole communication apparatus 118 may use frequencies below 3 kHz to transmit data signals in the well 100. Correspondingly, the near-field region for data signals communicated using frequencies within this range may extend a significant distance (e.g., greater than 500 m, or the like) through the subterranean region surrounding the downhole communication apparatus 118.

As shown by FIG. 1B, the installation system 120 is configured to provide a connection 128 between the interior surface 124 and the downhole communication apparatus 118 at a first location 130 and an additional connection 132 between the interior surface 124 and the downhole communication apparatus 118 at a second location 134 spaced from the first location 130. The connection 128 and the additional connection 132 provide two separate points of electrical contact between the downhole communication apparatus 118 and the interior surface 124.

In this embodiment, each portion 126 comprises metal (e.g., metal with a low melting temperature such as a metal alloy comprising Bismuth, or the like). The installation apparatus 120, 122 each comprise a portion 126 that is in a solid state when being deployed downhole. When required, a heating system (not shown), for example, an electrical or pyrotechnical heating system of the installation apparatus 120, 122 is activated to cause the portion 126 associated with each installation apparatus 120, 122 to change state so that the portion 126 melts to be, at least partially, in a fluid state. Once in a fluid state, the portion 126 may flow into the available space between the installation apparatus 120, 122 and the interior surface 124. As depicted by FIG. 1A, the installation apparatus 120, 122 each comprise a catch 136 extending radially outwardly from the installation apparatus 120, 122 for collecting or otherwise supporting the fluid portion 126 as it flows under the influence of gravity into the available space. Once in a fluid state, the portion 126 has a suitable fluidic property for conforming to the profile of the interior surface 124 of the well 100 to thereby provide the connections 128, 132. Since each portion 126 comprises metal, the connections 128, 132 also provide electrical contact between the downhole communication apparatus 118 and the interior surface 124.

Certain metals (such as metal alloys that comprise Bismuth) may expand upon changing to a solid state so that once set in solid form, the portion 126 forms a plug for isolating a section of the well 100. This expansion of the portion 126 may provide a high integrity seal with the interior surface 124.

Once the tool 112 has been installed, the cabling 114 may be withdrawn along with any components of the tool 112 that are detachable from the downhole communication apparatus 118 and/or installation apparatus 120, 122 so that the remaining parts of the tool 112 may be left in the well 100.

In use, the tool 112 may isolate a section of the well 100 with the two portions 126 associated with the installation apparatus 120, 122. By way of an example, the tool 112 here further comprises a perforating apparatus 138 such as a tubing-conveyed perforating (TCP) tool configured to perforate the formation 110 to stimulate flow of formation fluids or improve the pressure communication path. One or more downhole conditions such as pressure, temperature, or the like may be monitored by a monitoring system such as a gauge (not shown) associated with the downhole communication apparatus 118 (e.g., the gauge may be part of the downhole communication apparatus 118 itself). The tool 112 also comprises a sample chamber 140 configured to take a sample of fluid produced by the formation 110 or further sensors to measure the sample in situ.

As depicted by FIG. 1C, the downhole communication apparatus 118 is configured to communicate data signals 142 indicative of one or more of the downhole conditions through the subterranean region. Those data signals 142 are transmitted from the downhole communication apparatus 118 via the open-hole section 108 and are picked-up at the metallic well structure section 102 for propagation towards surface 106.

A surface communication apparatus 144, which is electrically connected to the metallic well structure section 102 as well as ground, is configured to receive those data signals 142. The signal path therefore comprises both the open-hole section 108 and the metallic well structure section 102 (e.g. essentially a hybrid signal path). The communication apparatus 118 may function as any type of communication apparatus such as a standalone transmitter and/or receiver, a communications repeater, or the like.

Optionally, a communications repeater 146 may be provided in the well 100 between the downhole communication apparatus 118 and the surface communication apparatus 144 to facilitate communication there between. In this embodiment, the communications repeater 146 is provided in the metallic well structure section 102 and may be used to receive data signals from the downhole communication apparatus 118 and transmit those data signals (e.g., amplified, re-encoded, or the like) via the metallic well structure section 102 towards the surface communication apparatus 144.

Figure 2:
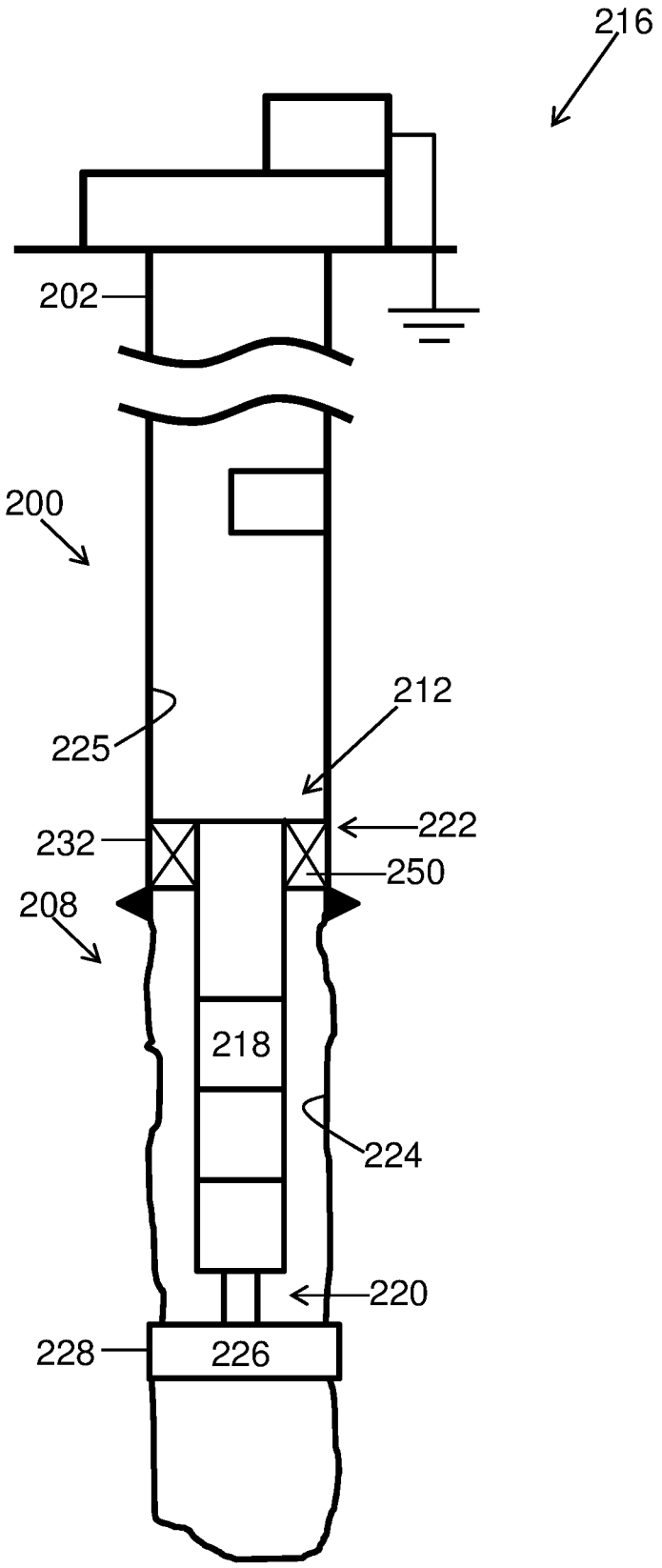
FIG. 2 is a schematic representation of an alternative communication apparatus deployed in a well.

FIG. 2 depicts an alternative embodiment of a communication system 216 for a well 200 comprising a communication apparatus 218 similar to that of FIGS. 1A to 1C. The communication system 216 comprises many of the same features as those described above in relation to the communication system 116 of FIGS. 1A to 1C. The reference signs for features that are the same as or similar to the corresponding features described in relation to FIGS. 1A to 1C have been incremented by 100. For brevity and where appropriate, the reference signs for certain features of the communication system 216 that are the same as or similar to those features described in relation to the communication system 116 have been omitted from the drawing. Different features are described in more detail below.

In the scenario depicted by FIG. 2, a tool 212 has been deployed in a well 200 in a similar manner as that described in relation to the tool 112 of FIGS. 1A to 1B (i.e., using cabling or any other appropriate technology). However, the tool 212 has been deployed to a downhole location that comprises both a metallic well structure section 202 and an open-hole section 208. The tool 212 comprises an installation system, which in this embodiment comprises two different types of installation apparatus 220, 222. A first of the installation apparatus 220 is configured to provide a first connection 228 using a portion 226 between the communication apparatus 218 and an interior surface 224 within the open-hole section 208. A second of the installation apparatus 222 is configured to provide a second connection 232 between the communication apparatus 218 and an interior surface 225 within the metallic well structure section 202.

The second connection 232 comprises an expandable packer or bridge plug arrangement 250 that is deployable downhole in a contracted state, which upon activation, is expanded into contact with the interior surface 225 by the second installation apparatus 222. The first connection 228 is provided by the same type of installation apparatus 220 as that used to install the portion 126 as described in relation to FIGS. 1A to 1C. Thus, the first connection 228 is provided by a different type of connection to that provided by the second connection 232. Both the expandable packer arrangement 250 and the portion 226 each provide electrical contact with the interior surfaces 225, 224 of the metallic well structure section 202 and the open-hole section 208, respectively. In use, the communication apparatus 218 may be configured to provide communication of data signals as part of the communication system 216 in a similar manner to that described in relation to FIG. 1C. The communication apparatus 218 may function as any type of communication apparatus such as a standalone transmitter and/or receiver, a communications repeater, or the like.

Figure 3:
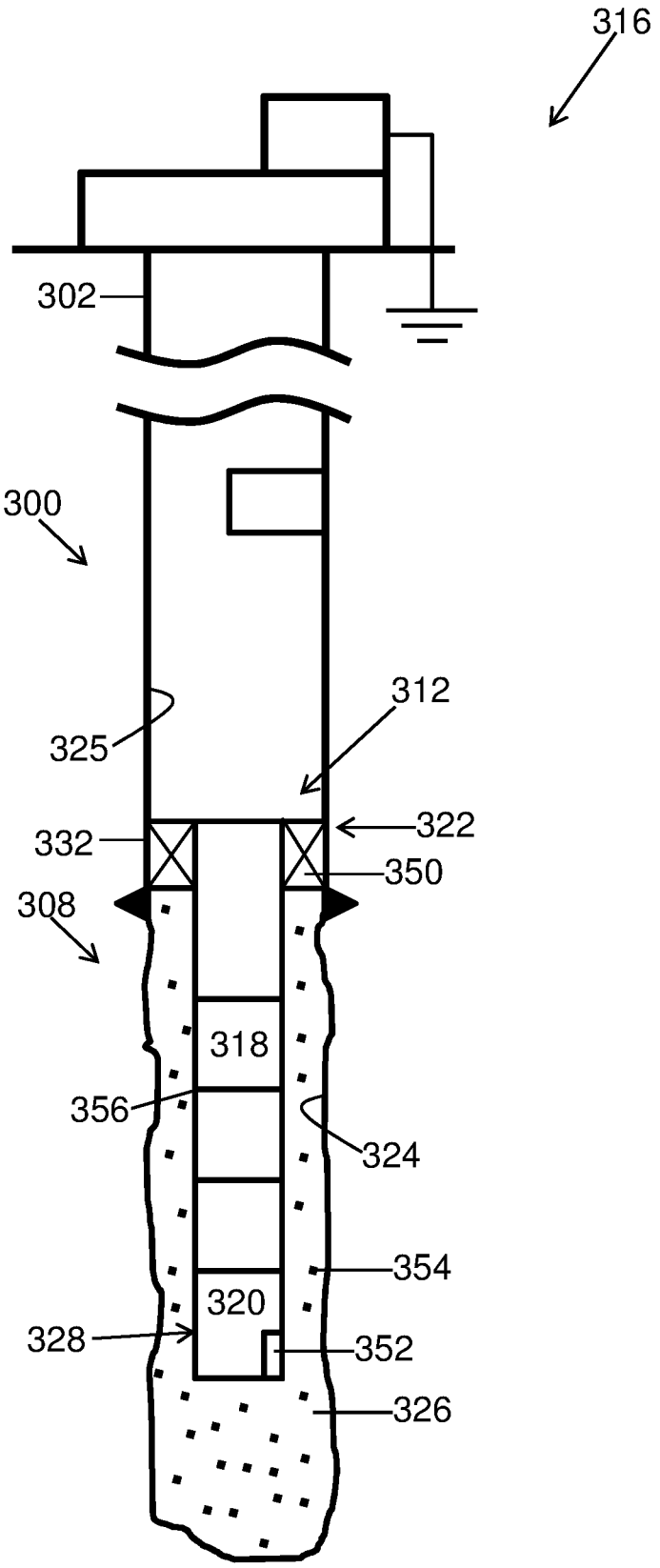
FIG. 3 is a schematic representation of an alternative communication apparatus deployed in a well.

FIG. 3 depicts an alternative embodiment of a communication system 316 for a well 300 comprising a communication apparatus 318 similar to that of FIGS. 1A to 1C and FIG. 2. The communication system 316 comprises many of the same features as those described above in relation to the communication systems 116, 216 of FIGS. 1A to 1C and 2. The reference signs for features that are the same as or similar to the corresponding features described in relation to FIGS. 1A to 1C have been incremented by 200. For brevity and where appropriate, the reference signs for certain features of the communication system 316 that are the same as or similar to those features described in relation to the communication system 116 have been omitted from the drawing. Different features are described in more detail below.

In the scenario depicted by FIG. 3, a tool 312 has been deployed in a well 300 in a similar manner as that described in relation to the tool 212 of FIG. 2. The tool 312 comprises an installation system, which in this embodiment comprises two different types of installation apparatus 320, 322. A first of the installation apparatus 320 is configured to provide a first connection 328 using a portion 326 between the communication apparatus 318 and an interior surface 324 within the open-hole section 308. A second of the installation apparatus 322 is configured to provide a second connection 332 between the communication apparatus 318 and an interior surface 325 within the metallic well structure section 302.

Similar to FIG. 2, the second connection 332 comprises an expandable packer or bridge plug arrangement 350 that is deployable downhole in a contracted state, which upon activation, is expanded into contact with the interior surface 325 by the second installation apparatus 322.

The first connection 328 is provided by a different type of installation apparatus to those described previously. The tool 312 is configured to deliver a portion 326 that is in the form of a fluid via a port 352 in the first installation apparatus 320. This fluid portion 326 may be deployed downhole in a fluid state from a fluid chamber (not shown) provided within the tool 112 where the fluid chamber may be provided in fluid communication with the well 100 via the port 352 when needed. Alternatively or additionally, the fluid portion 326 could be delivered by other methods such as via coiled tubing, or drill pipe or the like. The fluid portion 326 is sufficiently conductive to provide electrical contact between the communication apparatus 318 and the interior surface 324. In this embodiment, the fluid portion 326 comprises a mud comprising conductive particles 354 such as metal or other conducting fluids such as brine. In some examples, the fluid portion 326 may comprise or be in the form of settable material such as conductive cement (e.g., comprising conductive material or particles, or the like), or may comprise gels, or other such fluids, (e.g. including conductive particles or the like). As such, the fluid portion 326 may be initially provided in a fluid state such that the fluid portion 326 may conform to the interior surface 324. In some embodiments, the fluid portion 326 may remain in a fluid state when conformed to the interior surface 324. In some embodiments, the fluid portion 326 may optionally change state into solid form (e.g., such as a cement, or the like). In any event, it may be desirable for the portion (e.g. when in a fluid state) not to leach into the surrounding formation, or at least not leach significantly into that formation. As such, the portion or at least the fluid characteristics of the portion may be specifically selected for use, so as to avoid or otherwise mitigate leaching.

Both the expandable packer arrangement 350 and the portion 326 each provide electrical contact with the interior surfaces 325, 324 of the metallic well structure section 302 and the open-hole section 308, respectively. An isolation joint 356 may optionally be provided as part of the tool 312 between the first and second connections 328, 332 to avoid shorting or reduction in performance of the wireless signal. Additionally or alternatively, a separate isolation device (not shown) may be used to electrically isolate the portion 326 and/or the packer arrangement 350.

In use, the communication apparatus 318 may be configured to provide communication of data signals as part of the communication system 316 in a similar manner to that described in relation to FIG. 2, or indeed when having similar features to that shown in FIG. 1C for example, e.g. comprising a perforating apparatus 138 such as a tubing-conveyed perforating (TCP) tool configured to perforate the formation 110 to stimulate flow of formation fluids or improve the pressure communication path. The communication apparatus 318 may function as any type of communication apparatus such as a standalone transmitter and/or receiver, a communications repeater, or the like.

Figure 4:
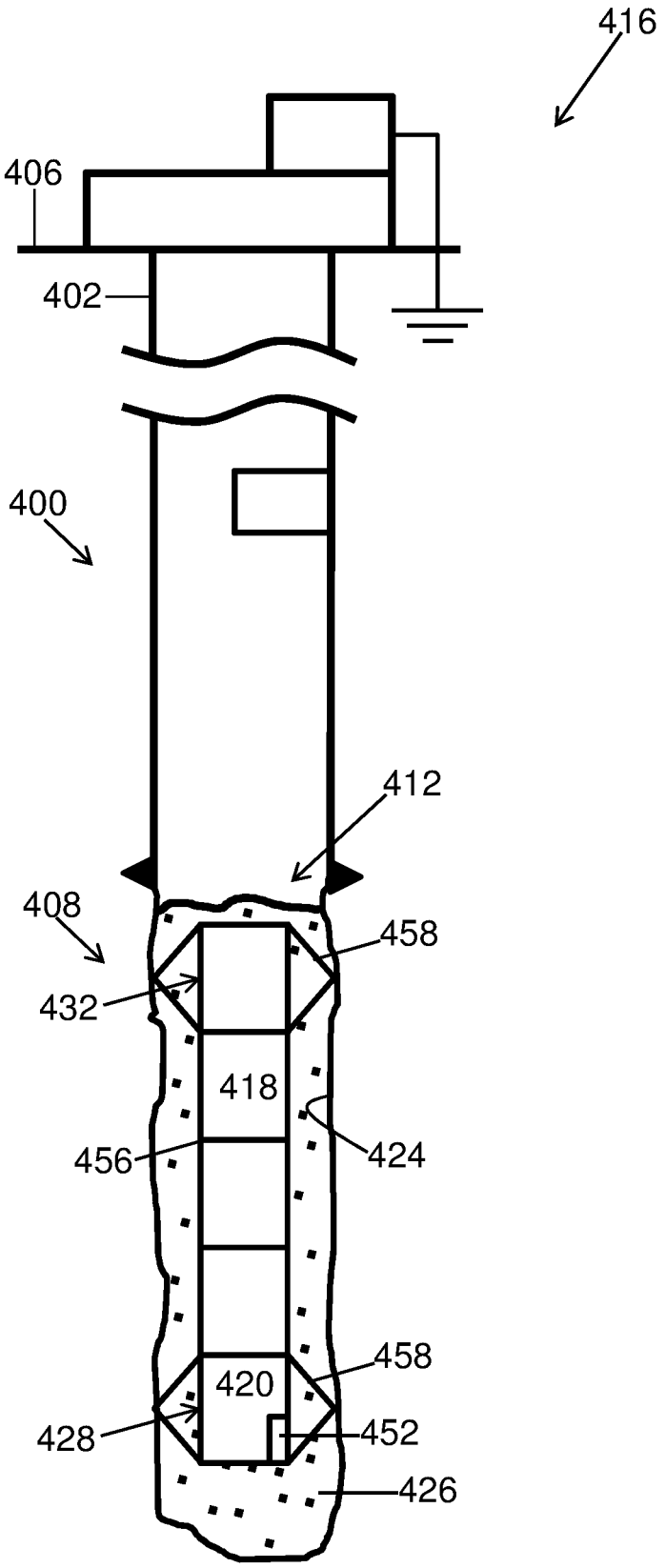
FIG. 4 is a schematic representation of an alternative communication apparatus deployed in a well.

FIG. 4 depicts an alternative embodiment of a communication system 416 for a well 400 comprising a communication apparatus 418 similar to that of FIGS. 1A to 1C, 2 and 3. The communication system 416 comprises many of the same features as those described above in relation to the communication systems 116, 216, 316 of FIGS. 1A to 1C, 2 and 3. The reference signs for features that are the same as or similar to the corresponding features described in relation to FIGS. 1A to 1C have been incremented by 300. For brevity and where appropriate, the reference signs for certain features of the communication system 416 that are the same as or similar to those features described in relation to the communication system 116 have been omitted from the drawing. Different features are described in more detail below.

In the scenario depicted by FIG. 4, a tool 412 has been deployed in a well 400 in a similar manner as that described in relation to the tool 112 of FIGS. 1A to 1C. The tool 412 comprises an installation system, which in this embodiment comprises an installation apparatus 420 (i.e., just a single type of installation apparatus). The installation apparatus 420 is configured to provide both a first connection 428 and a second connection 432 between the communication apparatus 418 and an interior surface 424 within the open-hole section 408. The tool 412 further comprises a hanger device 458 at each end of the tool 412 configured to support the tool 412 in the open-hole section 408. Of course, in some examples, the hanger device 458 may be provided at the top end of the tool, as will be appreciated. In any event, in this example once at a desired location in the well 400, the two hanger devices 458 extend from an initially contracted state (not shown) to an expanded state (as shown by FIG. 4) to become engaged with the interior surface 424 of the open-hole section 408 and thereby support the tool 412 once the support from cabling (or other device) has been withdrawn.

The tool 412 is configured to deliver a portion 426 that is in the form of cement or other conductive fluid via a port 452 in the installation apparatus 420. This cement portion 426 may be deployed downhole in a fluid state, for example, by being pumped from surface 406 via a string or other tubing (not shown) to be delivered in the open-hole section 408 via a port 452 of the installation apparatus 422. The cement portion 426 is sufficiently conductive to provide electrical contact between the communication apparatus 418 and the interior surface 424. For example, the cement portion 426 may comprise conductive particles 454 such as metal. The cement portion 426 is initially provided in a fluid state and subsequently changes state into solid form upon setting. The cement portion 426 may plug the well 400 once the cement has set.

Similar to the embodiment of FIG. 3, an isolation joint 456 may optionally be provided as part of the tool 412 between the first and second connections 428, 432 to avoid shorting. Additionally or alternatively, a separate isolation device (not shown) may be used to electrically isolate one part of the portion 426 proximal to the first connection 428 from another part of the portion 426 proximal to the second connection 432.

In use, the communication apparatus 418 may be configured to provide communication of data signals as part of the communication system 416 in a similar manner to that described in relation to FIG. 3. The communication apparatus 418 may function as any type of communication apparatus such as a standalone transmitter and/or receiver, a communications repeater, or the like.

Aspects or embodiments described herein may be combined or modified as appropriate. Features described in relation to one aspect or embodiment, even if not explicitly described in relation to another aspect or embodiment, may be applicable or used in that other aspect or embodiment.

Although the above embodiments have primarily been described as using EM signaling techniques, other signaling techniques such as acoustic may be facilitated using the portion 126, 226, 326, 426 described herein. Therefore, one or more communication apparatus may be configured to provide acoustic signaling instead of, or in addition to, EM signaling. The portion 126, 226, 326, 426 may provide a good quality mechanical connection with the interior surface 124, 224, 225, 324, 325, 424, which may facilitate communication of acoustic signals. Where acoustic signaling is used, the portion 126, 226, 326, 426 may be made from a material selected to provide, or at least optimize, impedance matching between the communication apparatus 118, 228, 328, 428 and the interior surface 124, 224, 225, 324, 325, 424. Additionally or alternatively, the portion 126, 226, 326, 426 may be configured with appropriate dimensions and/or other physical properties to minimize impedance mismatch-related losses at a transition between the portion 126, 226, 326, 426 and the communication apparatus and/or infrastructure such as a metallic well structure section.

Although embodiments described herein may refer to a single communications repeater, other embodiments may comprise more than one communications repeater. Similarly, there may be one or more of other types of infrastructure in the well, such as: one or more downhole communication apparatus; one or more surface communication apparatus; one or more metallic well structure sections.

Although embodiments described show the surface communication apparatus as being connected to a metallic well structure section and/or a wellhead, in other embodiments, the surface communication apparatus may not be connected to a metallic well structure section and/or a wellhead. For example, the surface communication apparatus may not be connected to any well infrastructure if a well has been abandoned such that well infrastructure has been removed to a particular level below the surface. A ground region may extend between surface and any well infrastructure below the surface. Similarly to signaling in an open-hole section described above, data signals may propagate through this ground region to provide communication between the remaining well infrastructure and the surface communication apparatus.

Although embodiments described herein describe transmission of data signals from the downhole communication apparatus to the surface communication apparatus, depending on the application, it is also possible for data signals to be transmitted from the surface communication apparatus to the downhole communication apparatus. Thus, signaling may be one-way or two-way between the downhole communication apparatus and the surface communication apparatus. In other similar words, the downhole communication apparatus and surface communication apparatus described herein may function as a standalone transmitter or a standalone receiver for one-way signaling, or may function as a transceiver for transmitting and receiving data signals.

Although embodiments described herein primarily relate to providing a connection in an open-hole section, embodiments described herein may be used to provide a connection in well infrastructure such as a metallic well structure section. For example, FIGS. 2 and 3 show one connection provided in a metallic well structure section and another connection in an open-hole section. However, in other embodiments, both of the connections may be provided in a metallic well structure section.

Although embodiments described herein show each communication apparatus as having two connections, in other embodiments, only one or more than two connections may be provided to facilitate communication of data signals.

The applicant discloses in isolation each individual feature described herein and any combination of two or more such features, to the extent that such features or combinations are capable of being carried out based on the specification as a whole in the light of the common general knowledge of a person skilled in the art, irrespective of whether such features or combinations of features solve any problems disclosed herein, and without limitation to the scope of the claims. The applicant indicates that aspects of the invention may consist of any such individual feature or combination of features. In view of the foregoing description it will be evident to a person skilled in the art that various modifications may be made within the scope of the invention.

The invention claimed is:

1. A method of establishing data signal communications between a communication apparatus and an interior surface disposed downhole within a subterranean well, the method comprising:

providing a tool having a communication apparatus, a first installation apparatus, and a second installation apparatus, wherein the first installation apparatus is configured to provide a first signal data communication path adjacent a first end of the tool between the communication apparatus and the interior surface, and the second installation apparatus is configured to provide a second signal data communication path adjacent a second end of the tool between the communication apparatus and the interior surface;

disposing the tool at a downhole location within the subterranean well; and controlling at least one of the first installation apparatus or the second installation apparatus to form the respective first signal data communication path or the second signal data communication path with a fluid that conforms to the interior surface at the downhole location.

2. The method of claim 1, wherein the first signal data communication path and the second signal data communication path provide an electrical connection or an acoustic connection, or both, between the interior surface and the communication apparatus.

3. The method of claim 1, wherein the interior surface is an open-hole section interior surface or is a metallic well structure interior surface.

4. The method of claim 1, wherein the controlling at least one of the first installation apparatus or the second installation apparatus to form the respective first signal data communication path or the second signal data communication path with the fluid, includes controlling a solid to change to the fluid that conforms to the interior surface at the downhole location, and controlling the fluid to subsequently resolidify.

5. The of claim 1, wherein the at least one of the first installation apparatus or the second installation apparatus that forms the respective first signal data communication path or the second signal data communication path with the fluid, comprises a metal or a settable material.

6. The method of claim 1, further comprising isolating a section of the subterranean well with the first installation apparatus and the second installation apparatus.

7. A communication method for a subterranean well comprising a communication apparatus installed in the subterranean well in accordance with the method of claim 1, the communication method comprising monitoring one or more downhole conditions and using the communication apparatus to communicate data signals indicative of one or more of the downhole conditions.

8. The method of claim 1, wherein the fluid is a settable material, and the method includes disposing the fluid in an annulus disposed between the tool and the interior surface while the fluid is in a fluid state.

9. The method of claim 8, wherein the settable material provided in the annulus disposed between the tool and the interior surface in a fluid state is configured to change state from the fluid state to a solid state after being provided in the annulus.

10. The method of claim 9, wherein the settable material is a conductive cement.

11. A communication system for a subterranean well, the subterranean well having an interior surface located at a downhole location, the system comprising:

a tool that includes a communication apparatus, a first installation apparatus, and a second installation apparatus;

wherein the first installation apparatus is configured to provide a first signal data communication path adjacent a first end of the tool between the communication apparatus and the interior surface, and the second installation apparatus is configured to provide a second signal data communication path adjacent a second end of the tool between the communication apparatus and the interior surface; and wherein at least one of the first installation apparatus or the second installation apparatus is configured to form the respective first signal data communication path or the second signal data communication path with a fluid that conforms to the interior surface at the downhole location.

12. The communication system of claim 11, wherein the first signal data communication path and the second signal data communication path provide an electrical connection or an acoustic connection, or both, between the interior surface and the communication apparatus.

13. The communication system of claim 11, wherein a portion of the first installation apparatus or the second installation apparatus is configured initially in a solid form, and is controllable to change to a fluid form that conforms to the interior surface at the downhole location, and controllable to subsequently resolidify.

14. The communication system of claim 11, wherein the portion of the first installation apparatus or the second installation apparatus comprises metal or a settable material.

15. The communication system of claim 11, wherein the first installation apparatus forms the first signal data communication path with the fluid that conforms to the interior surface at the downhole location, and the second installation apparatus that forms the second signal data communication path includes a packer arrangement.

16. The communication system of claim 11, wherein the communication apparatus comprises at least one of: at least one downhole communication apparatus and at least one communications repeater.

17. The communication system of claim 11, comprising at least one additional communication apparatus for communicating data signals with the communication apparatus via the subterranean region, wherein the at least one additional communication apparatus comprises at least one of: at least one communications repeater and at least one surface communication apparatus.

18. The communication system of claim 11, wherein the fluid is a settable material disposed within an annulus disposed between the tool and the interior surface and the fluid is configured to change state from a fluid state to a solid state within the annulus.

19. The communication system of claim 18, wherein the settable material is a conductive cement.

20. A communication system for a well, the system comprising:

a communication apparatus; and an installation system configured to provide a portion in a fluid state that conforms to an interior surface at a location in the well to form a connection between the interior surface and the communication apparatus to facilitate communication of data signals through a subterranean region;

wherein the communication apparatus is configured to use near-field communication to facilitate communication of data signals through the subterranean region.

* * * * *